United States Patent [19]

Marcon

[11] Patent Number: 4,506,805

[45] Date of Patent: Mar. 26, 1985

[54] DISPENSER DEVICE FOR LIQUIDS

[75] Inventor: Christian Marcon, Creteil, France

[73] Assignee: Valve Precision S.A.R.L., Palaiseau, France

[21] Appl. No.: 502,953

[22] Filed: Jun. 10, 1983

[30] Foreign Application Priority Data

Jun. 11, 1982 [FR] France ..... 82 10179

[51] Int. Cl.[3] ..... B67B 5/00

[52] U.S. Cl. ..... 222/153; 222/321; 222/383

[58] Field of Search ..... 222/321, 383, 385, 207, 222/209, 153, 182, 372, 402.15, 505, 502; 239/333, 331, 329, 600

[56] References Cited

U.S. PATENT DOCUMENTS

| | | | |
|---|---|---|---|
| 3,478,935 | 11/1969 | Brooks | 222/321 |
| 3,726,442 | 4/1973 | Davidson et al. | 222/207 |
| 3,927,834 | 12/1975 | Tada | 222/153 |
| 4,153,203 | 5/1979 | Tada | 239/333 |

*Primary Examiner*—Joseph J. Rolla
*Assistant Examiner*—L. Heim
*Attorney, Agent, or Firm*—William F. Kilgannon

[57] ABSTRACT

The spraying device for liquids comprises a piston pump which has a suction orifice intended to be immersed in the liquid and a piston rod slidably mounted opposite the suction orifice. This piston rod encloses an outward orifice for the liquid. The external case of the device comprises a delivery tube for mounting on the piston rod which carries laterally a nozzle for spraying the liquid, a trigger projecting outside the case for controlling depression of the rod of the piston pump and means for removably securing the case to the neck of the container. The case and the trigger are moulded as a single piece on a plastic material. The case has an opening which extends from the front face in which emerges the spraying nozzle to a rear face. The trigger is connected to the rear face of the case by means of a flexible tongue made from a plastic material which allows the trigger to be brought back from a moulding position where it is situated outside the case to a service position inside the case. The lateral spraying nozzle is free with respect to the case and the trigger, and the delivery tube comprises bearing surface for the trigger.

12 Claims, 17 Drawing Figures

DISPENSER DEVICE FOR LIQUIDS

The present invention relates to a spraying device for the liquids contained in a container.

The liquid to be sprayed contained in the container may for example be a detergent solution for spraying on surfaces such as those to be cleaned. Known spraying devices comprise a piston pump mounted in the container and having a suction orifice immersed in liquid and a piston rod slidably mounted opposite the suction orifice and projecting out of the container. This piston rod comprises an outlet orifice for the liquid. This device further comprises a case made from a plastic material having a delivery pipe for mounting on the rod of the piston pump and laterally carrying a nozzle for spraying the liquid. In this case, there is also provided a trigger projecting externally of this case for controlling depression of the rod of the piston of the pump, for expelling the liquid outwardly from the container through the delivery tube and the spray nozzle.

In known devices, the case, the trigger and the assembly formed by the delivery pipe and the spraying nozzle are separate parts which are moved separately.

The major drawback of these devices resides in the fact that mounting thereof is complicated and time wasting because of the different parts to be assembled. Furthermore, for assembling these different parts it is necessary to provide thereon specific portions such as hinges and pivots which are generally difficult to mould and which make the mould complicated and expensive.

The manufacture and assembly of these known spraying devices are thus relatively costly.

The aim of the present invention is to remedy the disadvantages of known constructions by providing a spraying device whose manufacture and assembly are very easy, and whose operation is also particularly trouble-free and reliable.

The spraying device to which the invention relates comprises a piston pump which has a suction orifice intended to be immersed in the liquid and a piston rod slidably mounted opposite the suction orifice, this piston rod comprising an outlet orifice for the liquid, as case enclosing the delivery tube for mounting on the piston rod which carries laterally a liquid spraying nozzle, a trigger projecting outside the case for controlling the pressure of the rod of the piston of the pump and means for removably securing the case to the neck of the container, the case and the trigger being integrally moulded from a plastic material.

Accordingly to the invention, this device is characterized in that the case has an opening which extends from the front face, in which emerges the spraying nozzle, to its rear face, in that the trigger is connected to the rear face of the case by means of a flexible plastic material tongue which allows the trigger to be brought back from the moulding position where it is situated outside the case to an operating position, inside the case, in that the lateral spraying nozzle is free with respect to the case and the trigger and in that the delivery tube comprises a bearing surface for the trigger.

The assembly formed by the case and the trigger formed as a single piece, may be moulded in a single mould, which constitutes a considerable improvement with respect to known constructions.

Mounting of the trigger in the case is very easy since it is sufficient to bring back said trigger inside the case by pivoting it about the hinge formed by the flexible tongue which connects the trigger to the case. Mounting of the delivery tube inside the case is also very easy since all that is required is to engage it on the rod of the piston of the pump and to cause the trigger to bear on the bearing surface of the delivery tube. Furthermore, the lateral nozzle of the delivery tube remains free with respect to the case and the trigger, which also provides a simplification in the manufacture and assembly of the device.

According to an advantageous embodiment of the invention, the front part of the case adjacent to the spraying nozzle comprises a flap which has means for locking the trigger in the inoperative position and which is connected to the case by a thinner portion which allows this flap to be brought back from a moulding position where it extends outwardly of the case and an operating position, where this flap masks the spraying nozzle and locks the trigger.

Thus this flap allows the trigger to be locked in the inoperative position, which avoids any possibility of spraying of the liquid during transport of the devices mounted on containers filled with liquid. This flap is like the trigger, integrally moulded with the case, which also reduces the moulding and assembly cost of the device.

According to a preferred embodiment of the invention, the trigger has an elongated body which extends in the operating position between the rear part and the front part of the case, this elongated body being extended by a gripping part projecting with respect to said front part and forming an obtuse angle with the elongated body, this latter having an internal recess open towards the opening of the case and in the opposite direction, in which recess may be engaged the outlet nozzle of the delivery pipe and the upper part of this delivery pipe.

Thus, the spraying nozzle and the delivery pipe are housed in the recess of the trigger, which considerably reduces the space required inside the case, while facilitating assembly of the delivery pipe inside the case.

In a particular embodiment of the invention, the rear part of the case has an internal stop on which abutts the parts of the trigger adjacent to the tongue, when the opposite end of the trigger is urged towards the rear of the case.

This stop thus absorbs forces applied to the trigger during spraying of the liquid, preventing tearing away of the plastic material, which connects the trigger to the case.

Means for securing the case to the neck of the container advantageously comprise a threaded ring for screwing on the neck of the container. Preferably, this ring has an axial sleeve whose diameter is substantially equal to the outer diameter of the delivery tube for axially guiding this latter, this ring comprising on its edge adjacent to the case means for clipping this case to this ring.

With these means, the assembly of the case on the container is extremely easy.

Further features and advantages of the invention will appear from the following description.

In the accompanying drawings, given by way of non-limiting examples:

Figure 1:
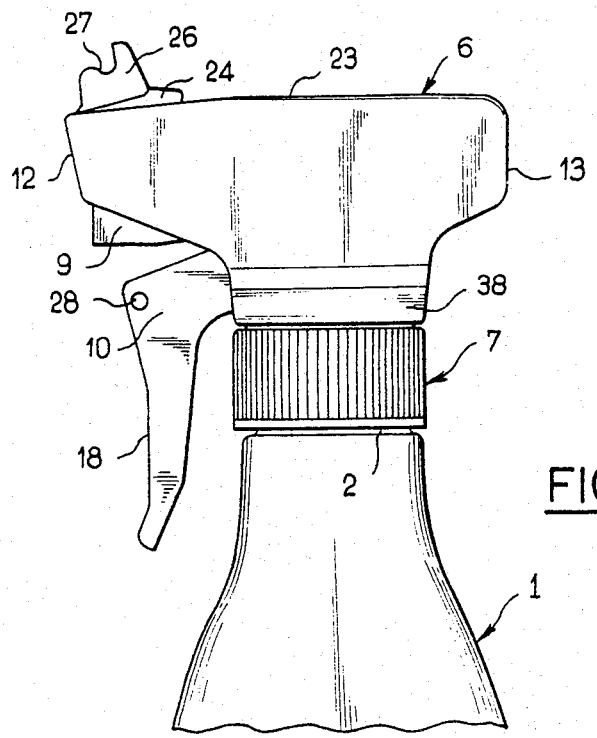
FIG. 1 is an elevational view of a spraying device according to the invention, mounted on a container and showing the trigger in the operating position.
Figure 2:
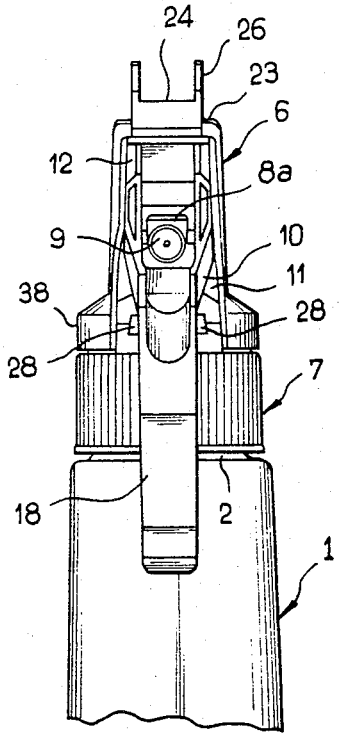
FIG. 2 is a view of the front of the device.
Figure 3:
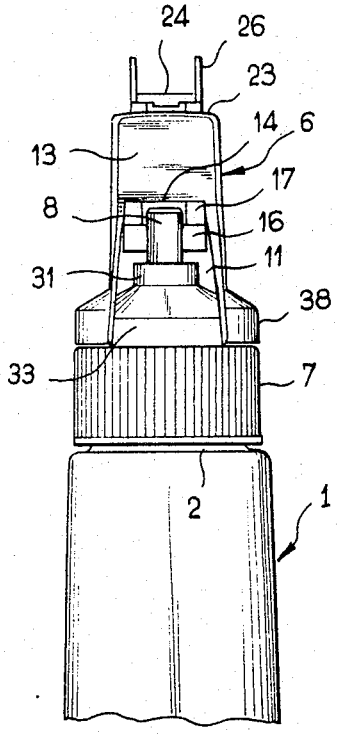
FIG. 3 is a view of the rear of the device.

In the embodiments in FIGS. 1 to 5, the spraying device in accordance with the invention, mounted on the neck 2 of a container 1, comprises a pump 3 (FIGS. 4,5) having a cylindrical body 3*a* which has a suction tube 5 for immersing in the liquid contained in container 1 and a piston rod 5 mounted for sliding along the axis of the pump and of neck 2 of container 1. This piston rod 5 has an outlet channel 5*a* for the liquid.

The spraying device further comprises a case 6 fixed on a threaded ring 7 secured on the neck 2 of container 1 and which encloses a delvery tube 8 having an internal cavity 8*b* mounted on rod 5 of pump 3 and carrying laterally a nozzle 9 for spraying the liquid, this case 6 also comprising a trigger 10 projecting outwardly of case 6 for controlling the depression of the rod 5 of pump 3.

In accordance with the invention, case 6 and trigger 10 are moulded as a single part from a plastic material such as polypropylene.

This case 6 has an opening 11 which extends from front face 12 in which emerges the spraying nozzle 9 to the rear face 13, so that this case 6 is totally open in the downward direction.

Trigger 10 is connected to the rear face 13 of case 6 by a flexible tongue 14 (see also FIG. 9) made from a plastic material of a smaller thickness than the wall 15 of the case. As will be explained in greater detail further on, this tongue 14 allows trigger 10 to be brought back from a moulding position in which it is situated outside case 6 (see FIGS. 7 and 8) towards the service position inside case 6 shown in FIG. 4.

The lateral spraying nozzle 9 integrally moulded with the cylindrical delivery tube 8 is free with respect to case 6 and trigger 10. This delivery tube 8 has on its lateral face two opposite studs 16 (see FIGS. 4 and 5) on which the central part of trigger 10 bears. In the embodiment shown, trigger 10 has an elongated body 17 which extends between the rear face 13 and the front face 12 of case 6, i.e. in the elongated direction thereof. This elongated body 17 is extended by a gripping part 18 projecting from the front face 12 of the case and forming an obtuse angle with the elongated part 17.

The elongated body 17 of trigger 10 has an internal recess 19 which communicates with the inside of case 6 through a wide opening 20 formed in wall 21 which constitutes the lower part of the elongated body 17. This opening 20 extends on each side of the axis of the rod 5 of the piston of the pump and of the delivery tube 8 fitted on this rod. As will be explained further on in greater detail, this opening 20 allows the spraying nozzle 9 and the upper part 8*a* of the delivery tube to be engaged inside the recess 19 of the elongated body 17 of trigger 10. The internal recess 19 of the elongated body 17 also opens towards the upper wall 23 of the case 6.

Figure 4:
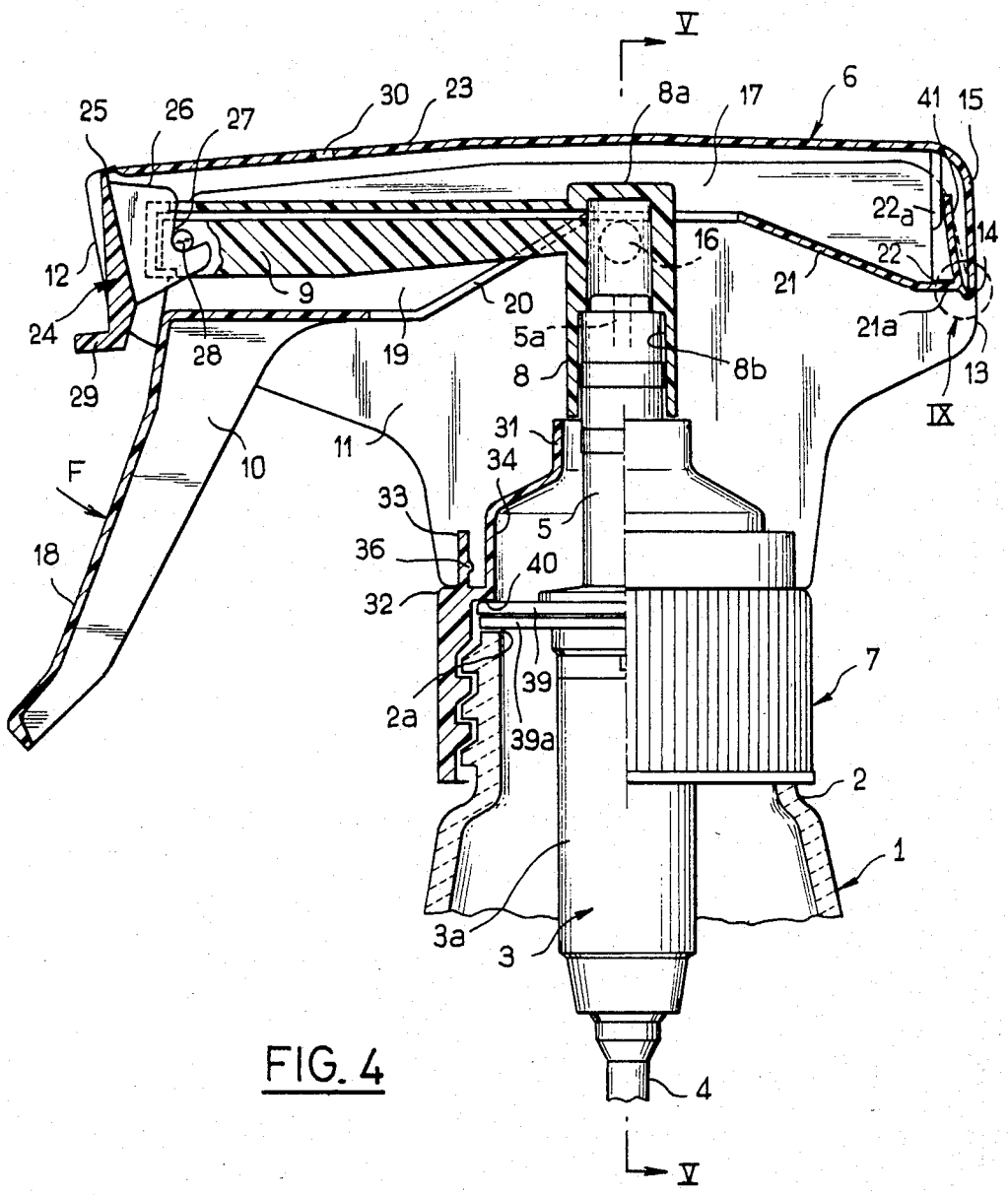
FIG. 4 is an enlarged view in longitudinal section and with parts cut away of the spraying device, in the service position on the neck of the container.
Figure 9:
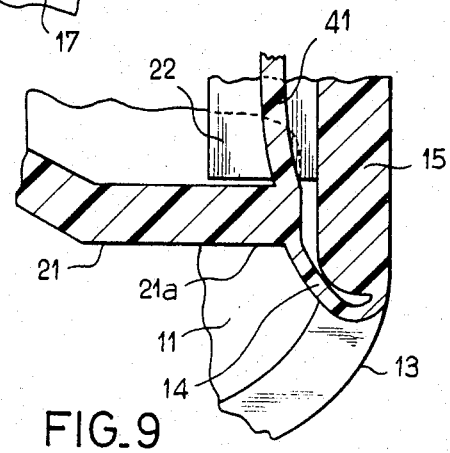
FIG. 9 is an enlarged view of detail IX of FIG. 4.
Figure 16:
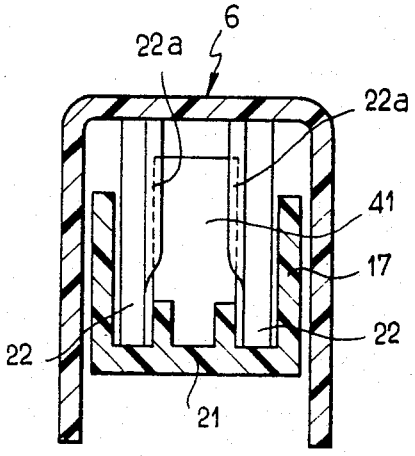
FIGS. 16 and 17 are sectional views respectively along planes XVI and XVII of FIG. 6.
Figure 17:
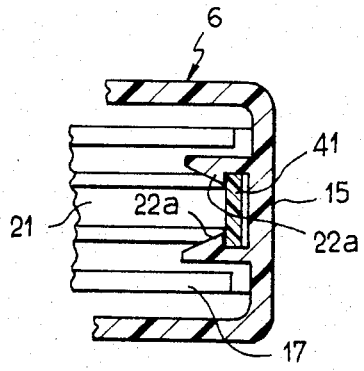

It can be further seen in FIGS. 4 and 9 that the rear part 13 of case 6 has an internal stop 22 against which abutts the portion 21*a* of the trigger 10 situated in the vicinity of the flexible tongue 14, when the gripping part 18 of trigger 10 is urged in the direction of arrow F of FIG. 4.

As is shown, especially in FIG. 4, on the upper wall 23 and at the front of case 6 there is disposd a flap 24 brought back over the front face of the case to mask the spraying nozzle 9 and lock trigger 10.

Figure 10:
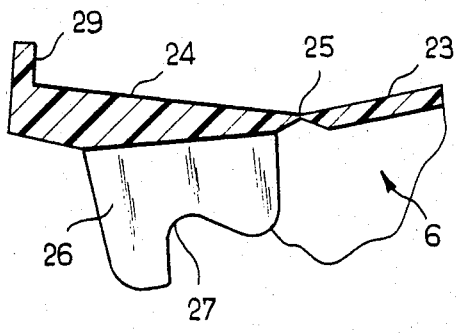
FIG. 10 is an enlarged view in longitudinal section of detail X of FIG. 7.

As can be seen in FIG. 10, flap 24 is integrally moulded with case 6 and is connected to the upper wall 23 of this latter by means of a thinner portion 25. This thinner portion 25 allows flap 24 to be brought back from a moulding position where it extends outwardly of the case 6 substantially in the elongated direction thereof (see FIGS. 7 and 10) to a service position where this flap 24 masks nozzle 9 and locks trigger 10 (see FIGS. 4 and 11) or to a position where this flap 24 is brought back over the upper part 23 of case 6 and is locked to this latter (see FIGS. 1 to 3 and 6).

In the embodiment shown (see more particularly FIG. 12) flap 24 comprises two wings 26 parallel to each other and perpendicular to the reduced thickness line 25, each having a locking hook 27 engaging with two locking fingers 28 projecting from the two lateral faces of trigger 10.

Figure 6:
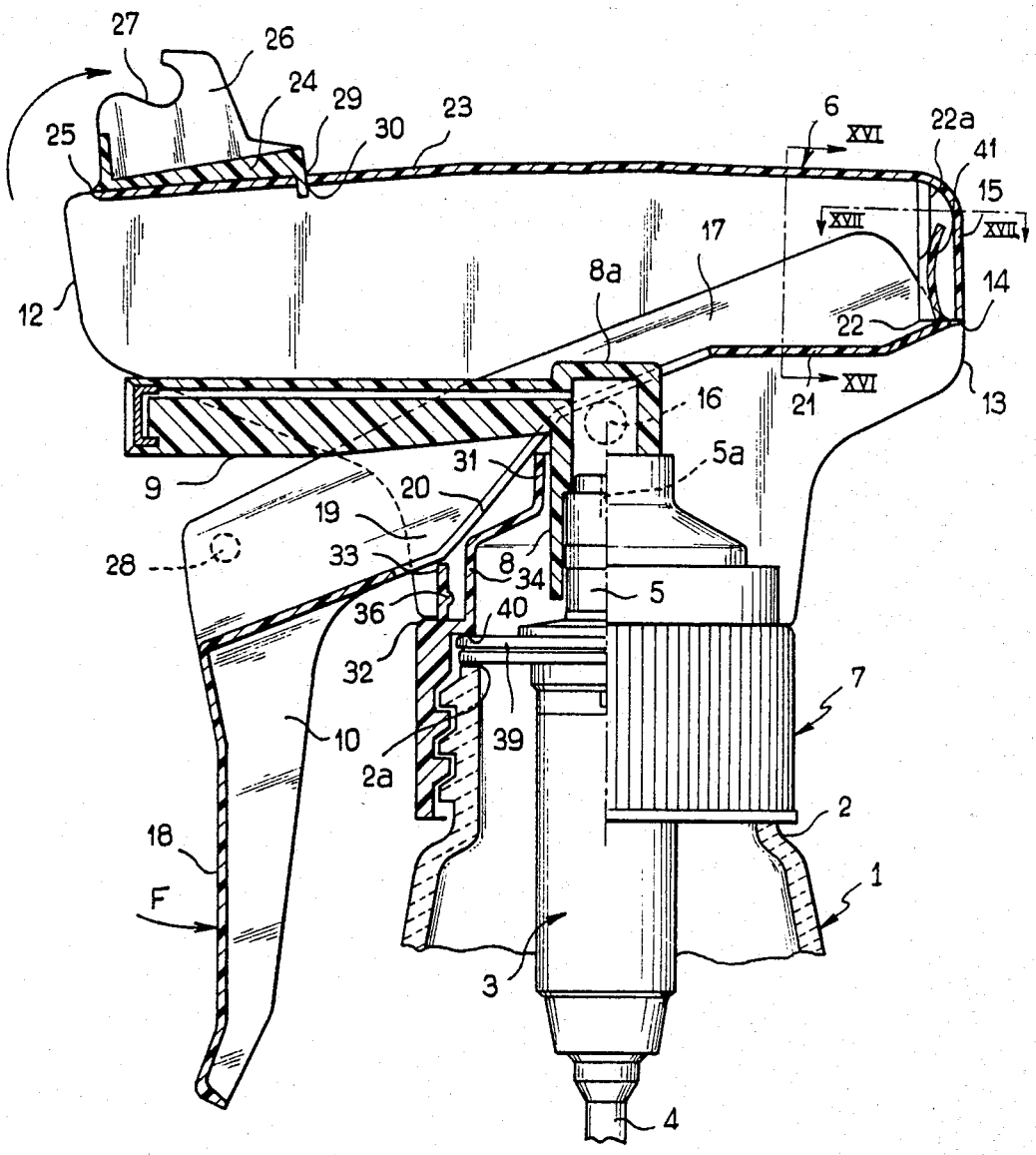
FIG. 6 is a view similar to FIG. 4 showing the trigger in a spraying position.

The end of flap 24 opposite the thinner position 25 further comprises a lug 29 for snap-fitting into an opening 30 provided in the upper wall 23 of the case for locking this flap in the position shown in FIG. 6.

Figure 5:
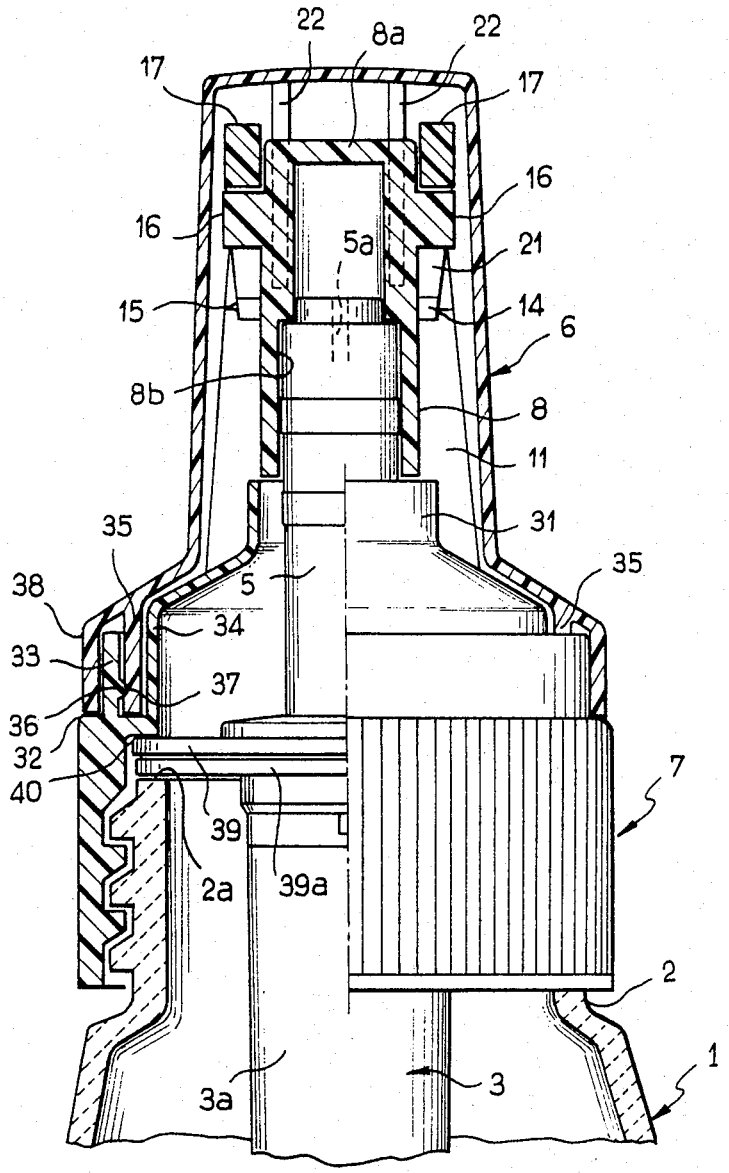
FIG. 5 is a sectional view along lane V—V of FIG. 4.

As shown in FIGS. 4 and 5, the means for securing case 6 to the neck 2 of the container 1 comprise a threaded ring 7 screwed on neck 2.

The upper part of this ring 7 carries an axial sleeve 31 whose inner diameter is substantially equal to the outer diameter of the cylindrical delivery tube 8 so as to be able to guide this latter when trigger 10 is urged, as shown in FIG. 6.

This ring 7 has on its edge 32 adjacent to case 6 two skirts 33, 34 coaxial with the axis of ring 7.

Case 6 comprises (see FIG. 5) two opposed lips 35 in the shape of an arc of a circle snap-fitting in the space between the two coaxial skirts 33, 34 of ring 7. This snap fit is provided by an annular rib 36 formed on the outer skirt 33, engaged in a complementary groove 37 formed in lips 35.

The snap fit thus obtained allows case 6 to rotate with friction with respect to threaded ring 7.

In FIG. 5 it can be further seen that case 6 has outer flanges 38 coaxial with lips 35 which, in the assembled position, cover the outer skirt 33 of the threaded ring 7.

Furthermore, pump 3 has a collar 39 which is clamped between the free edge 2*a* of neck 2 of container 1 and an annular shoulder 40 provided on the internal face of the threaded ring 7.

Assembly of the device which has just been described is as follows:

On leaving the mould, trigger 10 extends (see FIG. 7) outwardly of case 6 substantially in the elongated direction thereof. The same goes for flap 24.

To put the trigger into the service position, it is sufficient to bring it back to the direction of arrow $F_1$ towards the inside of case 6 so as to put it in the position shown in FIG. 4. During this operation, tongue 14 flexes from the substantially plane position shown in FIG. 8 to the position curved outwardly of case 6 shown in FIG. 9.

Then the spraying nozzle 9 and the upper part of delivery tube 8 are engaged in the opening 20 of trigger 10. The threaded ring 7 is fitted to the lower edge of case 6 by snap fitting the lips 35 of this latter in the space between the two coaxial skirts 33, 34 of the threaded ring 7.

Then the rod 5 of the piston of pump 3 is engaged in the guide sleeve 31 of ring 7 and in the delivery tube 8, then ring 7 is screwed onto the collar 39 and the gasket 39*a* of the pump 3 bearing against the neck 2 of container 1.

Figure 7:
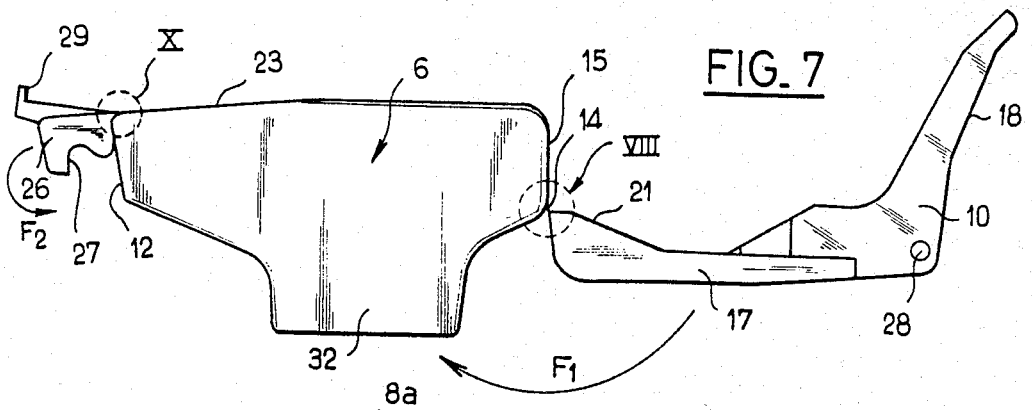
FIG. 7 is a view of the case of the device in the moulding position.
Figure 13:
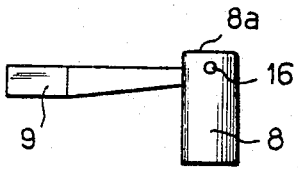
FIGS. 13, 14, 15 show respectively, the delivery pipe fitted with its spraying nozzle, the threaded ring and the pump in the order in which they are to be mounted in a case.
Figure 14:
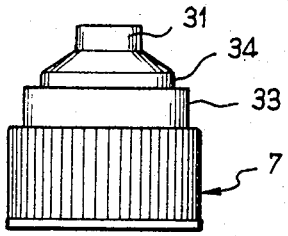
Figure 15:
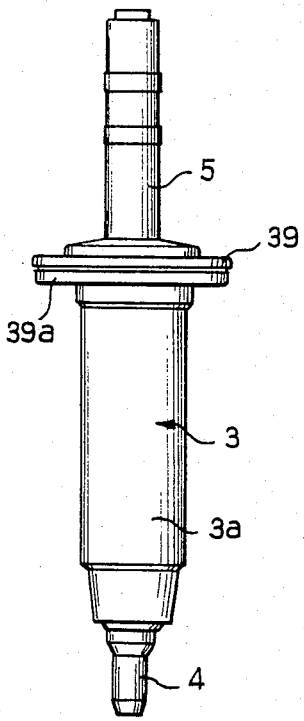
Figure 8:
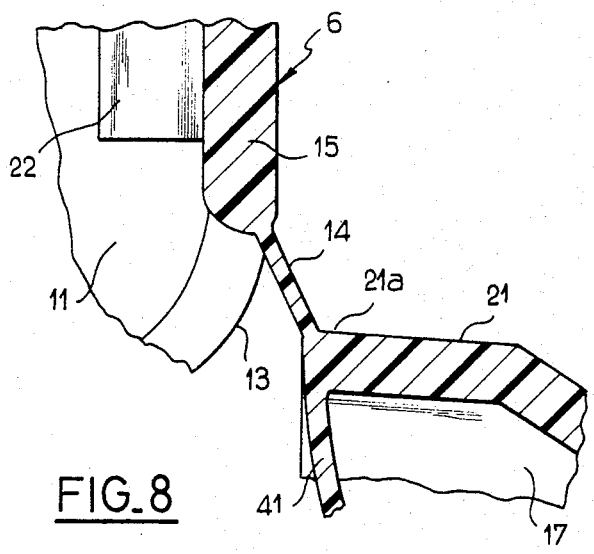
FIG. 8 is an enlarged view of detail VIII of FIG. 7.

All that is then required is to bring the flap 24 back in the direction of arrow $F_2$ of FIG. 7 to lock the trigger with respect to this flap (see FIGS. 11 and 12) which constitutes a safety feature particularly with respect to children.

Once the assembly is finished, trigger 10 rests on the stubs 16 projecting from the lateral face of delivery tube 8. The lateral nozzle 9 of this delivery tube 8 is free with respect to trigger 10 of case 6.

It can then be seen that the assembly device is very simple, extremely rapid, requires no particular skill nor special tools and provides perfectly accurate positioning of the different parts of the device, with respect to each other.

For spraying the liquid contained in container 1, trigger 10 is first of all released by bringing flap 24 upwards and by locking the lug 29 of this latter in the opening 30 provided in the upper wall 23 of case 6, shown in FIG. 6, then the trigger 10 is pressed.

As can be seen in FIG. 6, the whole of trigger 10 swings downwards while pivoting about the hinge formed by tongue 14.

The central part of the elongated body 17 of the trigger 10 bears on the lateral stubs 16 of delivery tube 8, so that this latter is depressed urging the piston rod 5 of pump 3 downwards, which controls expulsion of the liquid through delivery tube 8 and spray nozzle 9.

During the swinging of trigger 10, the end 21*a* of the latter adjacent to tongue 14 abutts against stop 22, which prevents tearing of tongue 14.

During depression of delivery tube 8, this latter is guided axially by sleeve 31 carried by the threaded ring 7. At the end of travel of trigger 10, shown in FIG. 6, the spray nozzle 9 which remains perpendicular to the axis of movement of delivery tube 8, projects outside the internal recess 19 of the elongated body 17 of trigger 10.

Figure 11:
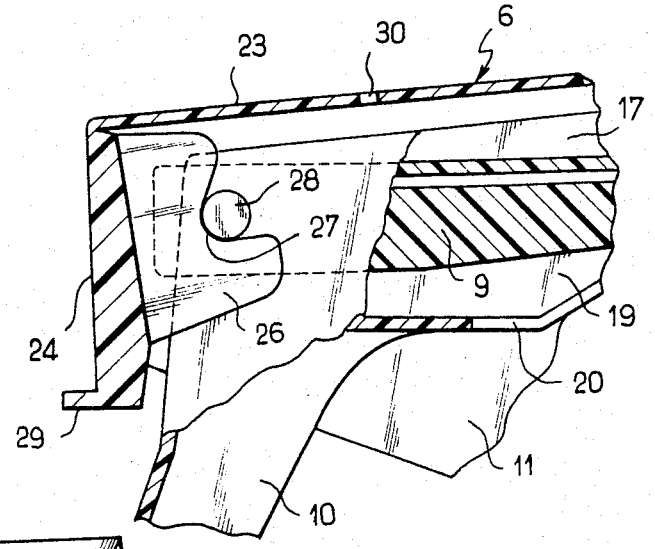
FIG. 11 is a view in longitudinal section with parts of the front portion of the device, the flap being in the locking position.
Figure 12:
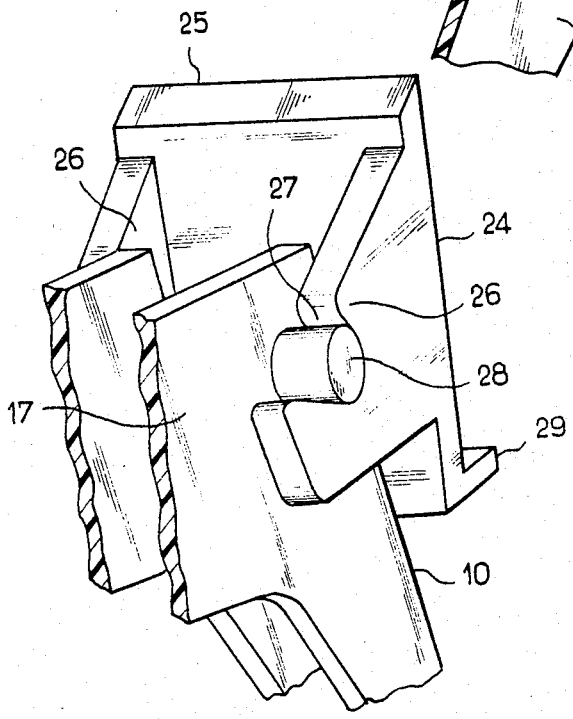
FIG. 12 is an enlarged perspective view of the flap in the locking position with respect to the trigger.

At the end of use of spraying device, trigger 10 can be again locked in the inoperative position by bringing flap 24 back into the position shown in FIGS. 4, 11 and 12.

Of course, the invention is not limited to the example which has just been described and numerous modifications may be made thereto without departing from the scope and spirit of the invention.

Thus, the form and the method of securing case 6 to neck 2 of container 1 may be different from those described.

Furthermore, trigger 10, instead of being symmetrical with respect to a plane passing through the axis of delivery tube 8, could be laterally opposite with respect to this plane and only comprise a single bearing point of delivery tube 8.

Furthermore, delivery tube 8 could be guided axially by a sleeve fixed to the inside of case 6 to the upper wall 23 thereof.

Moreover, flap 24 could be connected to the front face of case 6.

As shown in FIGS. 4, 6, 8, 9, 16 and 17, there may be provided at the rear of the elongated body 17 of the trigger a resilient tongue 41 bearing against ribs 22*a* provided on the stop 22 and exerting a return force tending to bring the trigger back to its inoperative position. When the trigger is brought back from the moulding position to the service position, this tongue 41 snaps behind the ribs 22*a*.

I claim:

1. A spraying device for liquids in a container (1) comprising a piston pump (3) which has a suction orifice (4) intended to be immersed in the liquid and a piston rod (5) slidably mounted opposite the suction orifice, this piston rod comprising an outward orifice (5*a*) for the liquid, a case (6) enclosing a delivery tube (8) for mounting on the piston rod (5) which carries laterally a nozzle (9) for spraying the liquid, a trigger (10) projecting outside the case (6) for controlling depression of the rod (5) of the piston pump and means for removably securing the case (6) to the neck (2) of the container, the case (6) and the trigger (10) being moulded as a single piece on a plastic material, characterized in that said case has an opening (11) which extends from the front face (12), in which emerges the spraying nozzle (9) to a rear face (13), in that the trigger (10) is connected to the rear face (13) of the case by means of a flexible tongue (14) made from a plastic material which allows the trigger (10) to be brought back from a moulding position where it is situated outside the case (6) to a service position inside the case (6), in that the lateral spraying nozzle (9) is free with respect to the case (6) and the trigger (10), and in that the delivery tube (8) comprises bearing surface (16) for the trigger (10).

2. The device as claimed in claim 1, characterized in that the front part (12) of the case (6) adjacent to the spraying nozzle (9) comprises a flap (24) which has means (27) for locking the trigger (10) in the inoperative position and which is connected to the case (6) by a reduced thickness portion (25) of its wall which allows this flap to be brought back from a moulding position where it extends outwardly of the case (6) to a service position where this flap (24) masks the spraying nozzle (9) and locks the trigger (10).

3. The device as claimed in claim 2, characterized in that the flap (24) further comprises means (29) for locking it in the folded back position on the upper part (23) of the case (6).

4. The device as claimed in claim 2, characterized in that the flap (24) has two wings (26) parallel to each other and perpendicular to the reduced thickness line (25), these two wings comprising locking blocks (27) engaging with two locking fingers (28) projecting from the opposite lateral faces of the trigger (10).

5. The device as claimed in claim 1, characterized in that the trigger (10) has an elongated body (17) which extends in the service position to the rear part (13) and the front part (12) of the case (6), this elongated body being extended by a gripping part (18) projecting from the said front part (12) and forming an obtuse angle with the elongated body (17), and in that this latter has an internal recess (19) open towards the opening (11) of the case (6) and in the opposite direction, in which recess (19) the spraying nozzle (9) of the delivery tube (8) in the upper part (8*a*) of this delivery tube may be engaged.

6. The device as claimed in claim 5, characterized in that in the service position of the delivery tube (8) in the elongated body (17) of the trigger (10), this elongated body rests on stubs (16) provided on the lateral face of the delivery tube (8).

7. The device as claimed in claim 1, characterized in that the rear part (13) of the case (6) has an internal stopper (22) against which abutts the part (21*a*) of the trigger (10) adjacent to the tongue (14), when the opposite end (18) of the trigger is pushed towards the rear of the case (6).

8. The device as claimed in claim 10, characterized in that the snap-fitting means (36, 37) allow rotation of the case (6) with friction with respect to the threaded ring (7).

9. The device as claimed in claim 7, characterized in that at the rear of the elongated body (7) of the trigger there is provided a resilient tongue (41) bearing on ribs (22*a*) formed on the stop (22) and exerting a return force which tends to bring the trigger back to its inoperative position.

10. The device as claimed in claim 9, characterized in that the tongue (41) is snap-fitted behind the ribs (22*a*).

11. The device as claimed in claim 1, the means for securing the case (6) to the neck (2) of the container (1) comprising a threaded ring (7) for screwing on the neck (2) of the container characterized in that this ring (7) supports an axial sleeve (31) whose inner diameter is substantially equal to the outer diameter of the delivery tube (8) for axially guiding this latter, this ring (7) comprising on its edge adjacent to the case (6) means (36, 37) for snap-fitting this case (6) to this ring (7).

12. The device as claimed in claim 11, characterized in that the edge adjacent to the case (6) of the threaded ring (7) has two skirts (33, 34) coaxial with the axis of the ring (7), in that the adjacent edge of the case (6) has two opposite lips (35) in the shape of an arc of a circle adapted to snap fit into the space between the two skirts (33, 34).

* * * * *